US005163685A

United States Patent [19]

Rhodes

[11] Patent Number: 5,163,685

[45] Date of Patent: Nov. 17, 1992

[54] SPORTS GRIP TRAINING DEVICE

[76] Inventor: Stephen B. Rhodes, 412 W. 2nd St., Roswell, N. Mex. 88201

[21] Appl. No.: 777,185

[22] Filed: Oct. 16, 1991

[51] Int. Cl.[5] ..... A63B 69/36

[52] U.S. Cl. ..... 273/187.5; 273/165; 273/192; 273/194 R; 273/29 A; 273/183 B

[58] Field of Search ..... 273/75, 162 R, 192, 273/183 B, 165, 166, 186 A, 194 R, 29 A, 193 R, 191 R, 186 C, 81.4

[56] References Cited

U.S. PATENT DOCUMENTS 3,203,697 8/1965 Berzatzy ..... 273/75
4,880,240 11/1989 Lewis ..... 272/192 X
4,991,839 2/1991 Lumbattis ..... 273/162 R X

*Primary Examiner*—George J. Marlo

*Attorney, Agent, or Firm*—Hoffman, Wasson & Gitler

[57] ABSTRACT

A sports grip training device for teaching a participant the proper positioning of his or her hands upon a sports implement. The device includes an abutment member which is adapted to be secured to the handle or grip of a sports implement with a predetermined angular orientation. When utilized with a golf club, the abutment member has a planar abutment surface that is at a 45° angle with respect to the longitudinal axis of the club's shaft. By positioning a golfer's upper hand in contact with the planar abutment surface, and completing the grip with the lower hand, a golfer is able to learn the proper golf grip in a simple and efficient manner. In addition to its usefulness as a golfer's aid, the device may be used with other sports implements, such as tennis and squash rackets.

14 Claims, 2 Drawing Sheets

SPORTS GRIP TRAINING DEVICE

FIELD OF THE INVENTION

The instant invention relates to sporting aids useful in training a golfer or tennis player to properly position his or her hands on a club or racket.

DESCRIPTION OF PRIOR ART

A consistent problem facing all golfers and tennis players is the proper positioning of a participant's hands on the handle of a golf club or tennis racket during use. It is critical when properly striking a golf ball or properly stroking a tennis ball that the participant's hands be positioned in such a way which will allow the ball to be struck squarely. Proper positioning of a participant's hand will also allow one to develop increased hand speed and shot or stroke accuracy.

This problem has been addressed by a number of inventors. For example, in U.S. Pat. No. 1,569,340 to Vaile, a "Ferrule For Golf Clubs" is disclosed. The ferrule includes a flange 2 that bears against the "little finger's outer side of the golfer's hand farthest from the club head." British Patent No. 239,706 discloses a device intended to prevent a club, bat or racket from slipping from the hands of a player. The device consists of a short cylindrical stop a which is cut at b and c to conform with the side and small finger of the left hand.

Other gripping devices include the "Stable Grip Tennis Racket Handle" disclosed by Berzatzy in U.S. Pat. No. 3,203,697. The grip includes an L-shaped support member 11 that is secured to the far end of a tennis racket handle such that a proper, constant and secure grip is provided.

Inventors have also previously attempted to provide for the proper positioning of a golfer's upper hand. Exemplary of these attempts are the gripping aids in U.S. Pat. No. 1,075,054 (Morley), U.S. Pat. No. 4,892,315 (Iorlano) and British Patent 2,213,738.

In addition to the patents discussed above, the following patents also disclose gripping aids: U.S. Pat. No. 1,102,441 (Sanford), U.S. Pat. No. 1,843,039 (Mohr), U.S. Pat. No. 1,855,126 (Connell), U.S. Pat. No. 2,086,974 (Belfore), U.S. Pat. No. 3,410,016 (Arsenault), U.S. Pat. No. 4,052,059 (Rigsby), U.S. Pat. No. 4,361,326 (Kokes) and U.S. Pat. No. 4,981,297 (Foster).

Although the prior art discussed above discloses a wide variety of devices intended to provide for the proper gripping of a handle, they all fail to provide for the proper angular alignment of a participant's hands upon a club or racket. That is, a conventional grip for a golfer requires the golfer's upper hand to be positioned at approximately a 45° angle with respect to the longitudinal axis of the shaft. This positioning is critical to a good golf swing and to taking the completed grip correctly. Once the upper hand is properly placed upon a club, the upper hand acts as an automatic guide for placement of a golfer's lower hand. The problems associated with properly gripping a golf club are similar to those associated with other sport implements. For example, a tennis player must also properly grip a tennis racket if he/she is to properly strike the ball. This is especially apparent during the forehand stroke and the serve where the racket is gripped with a user's hand at a definite angular orientation with respect to the longitudinal axis of the racket. In addition to tennis rackets, a squash racket must also be gripped at a proper angular orientation to achieve optimum performance.

In the instant invention, proper alignment is achieved by a planar abutment surface position adjacent the butt end of the golf club. The abutment is positioned at a 45° angle with respect to the longitudinal axis of the club and provides a surface which engages the outer edge of a golfer's upper hand to aid a golfer in correctly gripping the club. When the grip training device is utilized with other sports implements, for example, tennis or squash rackets, the angular orientation of the planar abutment surface may be modified to conform with the requirements of the specific sport. As a result, a completed correct grip is easily achieved once the upper hand is properly positioned.

Nothing in the prior art contemplates this problem or provides structure for overcoming the problem. For example, while the ferrule disclosed by Vaile is engaged by the outside of a golfer's upper hand and may help a golfer in maintaining a correct grip, the ferrule is primarily intended to prevent slippage and does not provide a golfer with proper alignment of his or her hands in the manner the instant invention contemplates. As to British Patent No. 239,706, the stop is provided to prevent a golfer's hands from slipping on the handle, and does not align a golfer's hand at the proper angular position. With regard to the other references discussed above, none of these references disclose nor suggest the instant gripping aid.

BRIEF DESCRIPTION

One of the greatest problems confronting golfers is the proper positioning of the user's hands on the golf club handle. This problem is overcome by the instant invention, which conveniently and simply positions a golfer's hands in their proper positions. The proper positioning will train the golfer into learning the correct golf grip.

The gripping aid includes a planar abutment member which is secured to the handle end of the golf club. The planar abutment member has an annular shape such that the central opening may be positioned about the club's grip. The secure attachment of the gripping aid is further achieved by the use of a tubular member which is attached to one side of the abutment member. The tubular member has an open and a closed end, and is attached to the abutment member such that it is in alignment with the abutment member's opening.

The gripping aid is designed such that when the little finger side of a golfer's upper hand is engaged with the planar abutment surface, the golfer's hand will be set at the proper angular orientation. Once the upper hand is properly positioned, the upper hand then acts as an automatic guide for the proper positioning of the golfer's lower hand. This is a result of the abutment surface preferably being mounted at a 45° angle with respect to the longitudinal axis of the golf club's shaft.

It should be noted that the instant gripping aid may be used with right or left handed clubs. In addition, the aid may be used with any handle where a proper grip is critical for the optimum use of the instrument. For example, the aid could be used with tennis or squash rackets as a proper grip is critical in both sports. For example, during the forehand stroke and the serve, a tennis player must position his/her hand at a proper angular orientation with respect to longitudinal axis of the tennis racket. Consequently, when a player wishes to practice either stroke, the grip training aid can be positioned adjacent the butt end of the grip to teach a user the proper place to position his or her hand. It should be noted, however, that the angular orientation of the training aid would have to be modified to accommodate proper gripping technique for a tennis racket.

DETAILED DESCRIPTION

Figure 1:
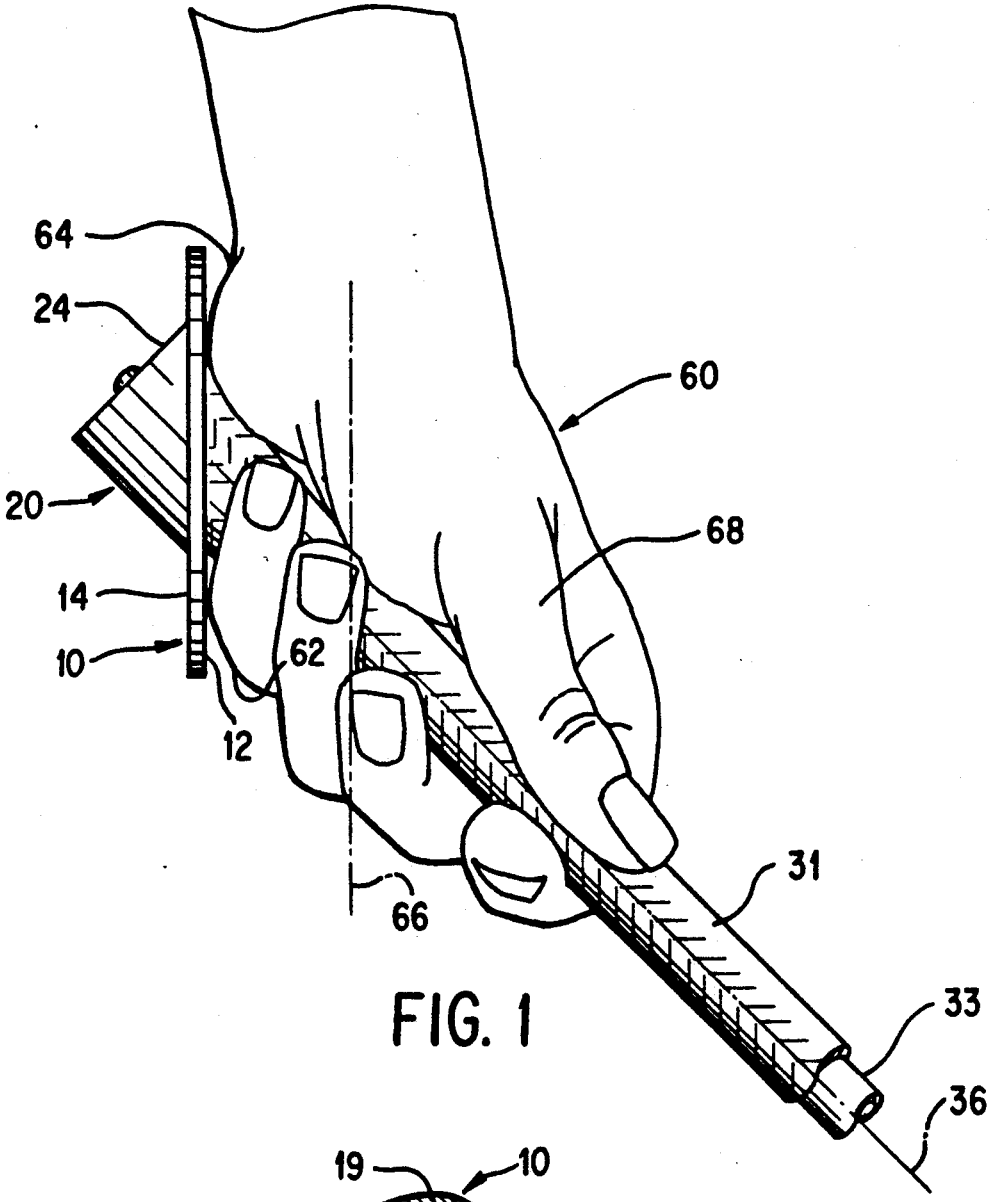
FIG. 1 shows a perspective view of the grip training device in use.
Figure 2:
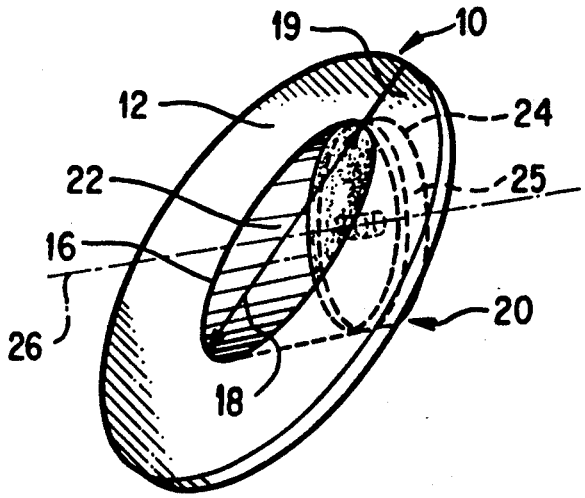
FIG. 2 is a plan view of the grip training device.

The gripping aid shown in FIGS. and 2 includes abutment member 10 with a cylindrical connection member 20 attached thereto. The abutment member 10 is preferably constructed as an annular disc and includes a central opening 16, a planar abutment surface 12, and an outer surface 14. The central opening 16 has a generally elliptical shape and is large enough to allow the abutment member to be placed around the grip with the planar abutment surface 12 at a 45° angle relative to the longitudinal axis 36 of the club's shaft 33.

Although the preferred embodiment discloses the abutment member 10 as being an annular disc, the abutment member may take on a variety of forms so long as the planar abutment surface 12 is positionable at its proper angular orientation. In addition, the abutment surface need not be completely planar, but may be substantially planar and include some contouring to engage the outside of the golfer's upper hand.

The cylindrical connection member 20 is secured to the outer surface 14 of the abutment member 16. The connection member 20 has an open end 22 and a closed end 24. In addition, the connection member 20 has a diameter slightly larger than that of the club's grip 31. In order to properly position the abutment member 10 on the end of the club's grip 31, the open end 22 is cut at a 45° angle with respect to the longitudinal axis 26 of the connection member 20. However, the shape of the open end 22 may take on a variety of forms depending upon the shape of the abutment member's outer surface 14; the only critical factor being that the planar abutment surface 12 must be positioned at the proper angular orientation with respect to the longitudinal axis 36 of the club's shaft.

Figure 3:
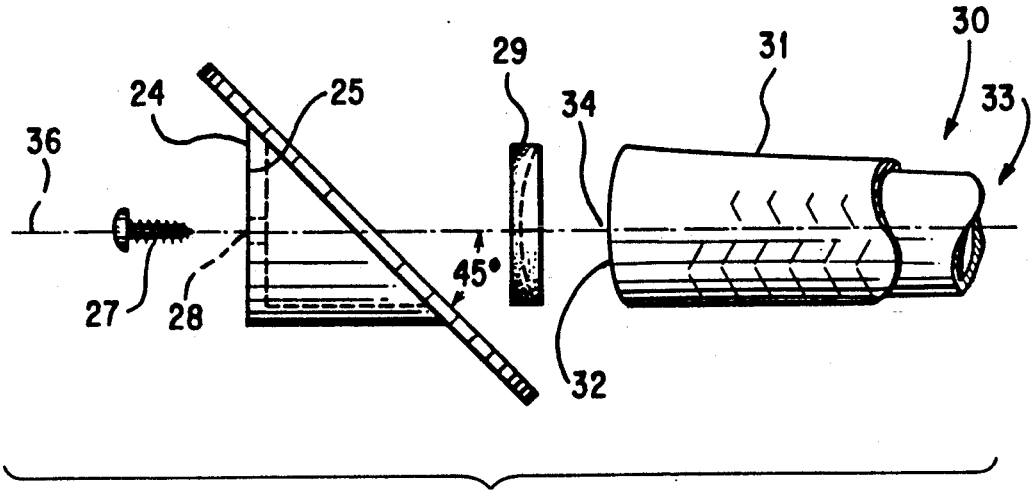
FIG. 3 is an exploded view of the grip training device.

As shown in FIG. 3, the gripping aid is secured to the butt end 32 of the golf grip 31. The butt end 32 is placed through the central opening 16 and the open end 22 of the connection member 20 until it is in contact with the closed end 24 of the connection member 20. The closed end should have an interior surface 25 which conforms with the outer surface of the grip's butt end 32. That is, normally the butt end 32 has a convex shape and the interior surface 25 should therefore have a matching concave shape. As shown in FIG. 3, a washer 29 that conforms with the shape of the club's butt end 32 may be positioned between the interior surface 25 and the club's butt end 32 to better center the gripping aid on the club 30 and for a more secure attachment of the gripping aid and the club 30. The washer 29 may be metal or plastic and is preferably glued to the club's butt end 32.

The gripping aid is releasably secured to the club 30 by a screw 27 that extends through a hole 28 in the closed end 24 of the connection member 20. After passing through hole 28, the screw 27 is screwed into the pilot hole 34 conventionally found in the butt end 32 of golf grips 31. It should be noted that other attachment structures could be utilized in accordance with the instant invention. In addition, permanent attachment structures, such as adhesives, could be utilized if desired.

As previously stated, it is critical for the planar abutment surface 12 to have the proper angular orientation with respect to the longitudinal axis of the club's shaft 33. In the preferred embodiment, the abutment surface 12 should be oriented at approximately forty-five degrees (45°) with respect to the longitudinal axis of the club's shaft 33. However, this angular orientation may vary between approximately 35° and approximately 55° depending upon the preference of the golfer.

As discussed above, the gripping aid may be utilized with other handled instruments. In such instances, it may be desirable to vary the angular orientation of the abutment surface in accordance with the preferred gripping technique for the instrument.

Figure 4:
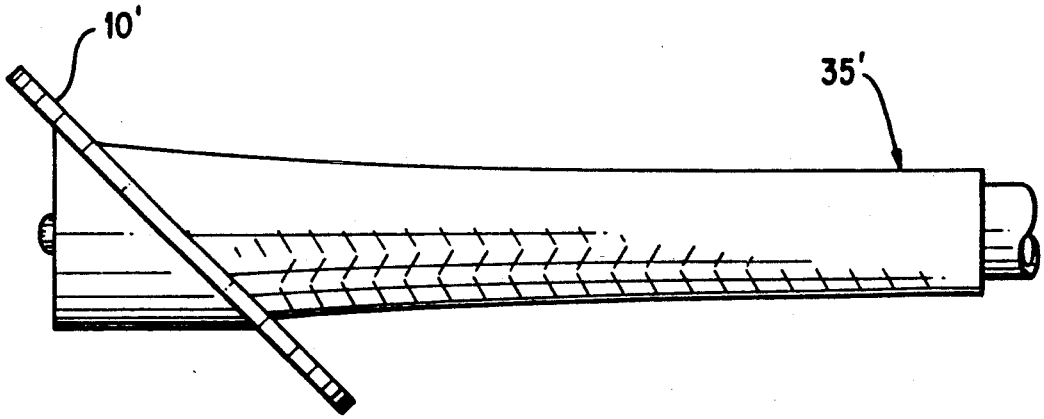
FIG. 4 shows an alternate embodiment of the grip training device.

FIG. 4 shows an alternate embodiment of a practice grip (club) having the gripping aid permanently attached thereto. In this embodiment, only the abutment member 10' is provided as the member 10' is integrally molded with the grip 35'.

When utilized to practice a conventional grip, the gripping aid is positioned on the grip 32 such that the long diameter 18 of the elliptical center hole 16 is contained in the same plane as the longitudinal axis 36 of the club's shaft 33. The planar abutment member 12 is provided with a reference marker 19. The reference marker 19 is aligned with the long diameter 18 and aids a user in properly positioning the training aid on a golf grip 31. Once the gripping aid is properly secured to the golf club 30, the user may then position his or her upper hand 60 adjacent to the planar abutment surface 12 of the abutment member 10. It should be noted that the upper hand 60 refers to the hand located nearest the butt end 32 of a club 30 when a conventional golf grip is utilized. In the case of a right-handed golfer, the upper hand would be the left hand, while a left-handed golfer's upper hand would be his or her right hand. The gripping aid of the instant invention may be utilized by either left or right handed golfers.

In positioning the golfer's upper hand 60 adjacent to the abutment surface 12, the outside of the little finger 62 and the outer edge 64 of the upper hand 60 should be in nearly complete contact with the abutment surface 12. If positioned properly, the longitudinal axis 66 of the golfer's hand should be at approximately the same angle relative to the club's shaft 33 that the abutment surface 12 is at relative to the club's shaft 33.

After the upper hand 60 is properly positioned, the correct completed grip naturally follows. That is, the upper hand's thumb 68 then acts as an automatic guide for the placement of the right hand. As the upper hand's thumb 68 extends down the grip it fits comfortably along the "Lifeline" of the lower hand's palm; that is, it extends between the thumb and index fingers of the lower hand.

By continuously practicing the proper grip described above, a golfer is able to learn the correct golf grip in a reliable and efficient manner. Once the participant has practiced with his/her upper hand in contact with the grip training aid, it is desirable to slide the hands down the grip and practice swinging without the help of the gripping aid. This allows a user to learn the proper grip and then quickly practice what has been learned when it is still fresh in his/her mind.

In addition to practicing a conventional grip, the gripping aid may be used to practice strengthened or weakened grips. For a right-handed golfer, a strengthened grip is achieved by rotating the gripping aid in a clockwise direction (when looking down the club's shaft) from the position used for a normal grip and gripping the club as discussed above. Such a strengthened grip helps a golfer "draw" the ball when properly struck. As to a weakened grip, which is utilized to "fade" the ball, the gripping aid is rotated in a counterclockwise direction. It should be noted that the rotation directions should be reversed for a left-handed golfer.

The gripping aid may be manufactured from a variety of materials. For example, it may be manufactured out of plastic by injection molding techniques or it may be constructed from fiberboard. In addition, a variety of other material may be used in accordance with the scope of this invention.

What is claimed is:

1. A gripping aid for attachment to the handle of a sports implement comprising:

an abutment member;

said abutment member includes a substantially planar abutment surface and means for securing said abutment member to the handle such that said planar abutment surface faces the handle and said planar abutment surface is at an angle from 35° to 55° relative to the longitudinal axis of the handle;

wherein said planar abutment surface engages a user's hand to align the user's hand at a predetermined angular orientation, while a user grips and swings the sports implement to which the handle is attached.

2. A gripping aid according to claim 1, including a handle, wherein said planar abutment member is formed integrally with said handle.

3. A gripping aid according to claim 1, wherein said planar abutment surface includes a central opening adapted to receive the handle and said securing means is positioned adjacent said opening.

4. A gripping aid according to claim 3, wherein said securing means is a cylinder having an open and a closed end, said cylinder having a longitudinal axis which is at an angle from 35° to 55° relative to said planar abutment surface.

5. A gripping aid according to claim 4, wherein said securing means includes a fastener passing through a hole in said closed end to selectively attach the gripping aid to the handle end of a sports implement.

6. A gripping aid according to claim 5, wherein said planar abutment surface is at a 45° angle relative to said cylinder's longitudinal axis.

7. A gripping aid according to claim 1, wherein said planar abutment surface is at a 45° angle relative to said sports implement's longitudinal axis.

8. A method for properly aligning a participant's grip on a sports implement handle comprising the steps of, securing a gripping aid according to claim 1 to the handle end of a sports implement;

positioning a first hand adjacent said planar abutment surface such that the outside of the little finger and the outerside of the palm are engaging said planar surface; and then using said sports implement with said hand engaging said planar abutment surface.

9. A method for properly aligning a participant's grip according to claim 8, wherein said planar abutment surface is at a 45° angle relative to the longitudinal axis of said sports implement.

10. A method for properly aligning a participant's grip according to claim 8, further including the step of positioning a participant's second hand adjacent the first hand.

11. A method for properly aligning a participant's grip according to claim 10, wherein said planar abutment surface is at a 45° angle relative to the longitudinal axis of the sports implement.

12. A method for properly aligning a participant's grip according to claim 8, further including the step of moving said first hand away from said planar abutment surface and using said sports implement.

13. A method for properly aligning a participant's grip according to claim 8, wherein the sports implement is chosen from the group consisting of a golf club, a tennis racket, and a squash racket.

14. A gripping aid for insuring the proper alignment of a golfer's hands comprising:

a planar abutment surface having a central opening for positioning said abutment surface on a golf club grip; and a tubular member attached to said abutment member adjacent to said central opening wherein said tubular member is closed at an end which is remote from said central opening and said tubular member further includes means for releasably attaching the gripping aid to a golf club;

and wherein said tubular member has a longitudinal axis which is at an angle from 35° and 55° relative to said planar surface.

* * * * *